US009984655B2

(12) United States Patent
Han et al.

(10) Patent No.: US 9,984,655 B2
(45) Date of Patent: May 29, 2018

(54) APPARATUS AND METHOD FOR TRANSMITTING DISPLAY SIGNAL HAVING A PROTOCOL INCLUDING A DUMMY SIGNAL AND A CLOCK SIGNAL

(71) Applicant: SILICON WORKS CO., LTD., Daejeon (KR)

(72) Inventors: Yun Tack Han, Anyang-si (KR); Hyun Kyu Jeon, Daejeon-si (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days. days.

(21) Appl. No.: 15/062,895

(22) Filed: Mar. 7, 2016

(65) Prior Publication Data

US 2016/0260411 A1 Sep. 8, 2016

(30) Foreign Application Priority Data

Mar. 6, 2015 (KR) ..... 10-2015-0031305

(51) Int. Cl.
*G09G 5/00* (2006.01)

(52) U.S. Cl.
CPC ..... *G09G 5/008* (2013.01); *G09G 2330/06* (2013.01); *G09G 2370/08* (2013.01); *G09G 2370/14* (2013.01)

(58) Field of Classification Search
CPC .... G09G 3/2092; G09G 3/2096; G09G 5/006; G09G 2370/08
See application file for complete search history.

(56) References Cited

U.S. PATENT DOCUMENTS 8,314,763 B2 * 11/2012 Park ..... G09G 3/2096 345/100
8,493,373 B2 * 7/2013 Jeon ..... G09G 3/20 345/100
8,947,412 B2 * 2/2015 Jeon ..... G09G 3/3611 345/204
9,203,606 B2 * 12/2015 Han ..... G09G 5/008
2009/0046784 A1 * 2/2009 Tsukamoto ..... G06F 13/4291 375/247
2010/0225620 A1 * 9/2010 Lee ..... G09G 3/20 345/204

(Continued)

FOREIGN PATENT DOCUMENTS

KR 10-0868299 11/2008
KR 10-0899781 5/2009
KR 10-2009-0101053 9/2009

(Continued)

*Primary Examiner* — Gene W Lee
(74) *Attorney, Agent, or Firm* — Kile Park Reed & Houtteman PLLC

(57) ABSTRACT

Disclosed is an apparatus and method for transmitting a display signal having a protocol including a dummy signal and a clock signal. The apparatus for transmitting a display signal may include: a transmitter configured to transmit a display signal in which a dummy signal and a clock signal are sequentially embedded between image data; and a receiver configured to receive the display signal. Since a sufficient margin can be secured before and after the point of time that the clock signal is extracted between the image data, a stable operation of the system can be guaranteed, and the system interface can prevent the occurrence of EMI.

13 Claims, 10 Drawing Sheets

(56) References Cited

U.S. PATENT DOCUMENTS

| | | | | |
|---|---|---|---|---|
| 2011/0242066 | A1* | 10/2011 | Jeon | G09G 3/20 345/204 |
| 2011/0286562 | A1* | 11/2011 | Jeon | G09G 3/20 375/371 |

FOREIGN PATENT DOCUMENTS

| | | |
|---|---|---|
| KR | 10-0924704 | 11/2009 |
| KR | 10-2011-0091383 | 8/2011 |
| KR | 10-1438478 | 9/2014 |
| KR | 10-2015-0089914 | 8/2015 |

* cited by examiner

APPARATUS AND METHOD FOR TRANSMITTING DISPLAY SIGNAL HAVING A PROTOCOL INCLUDING A DUMMY SIGNAL AND A CLOCK SIGNAL

BACKGROUND

1. Technical Field

The present disclosure relates to display signal transmission, and more particularly, an apparatus and method for transmitting a display signal having a protocol which includes a dummy signal and a clock signal.

2. Related Art

A flat panel display device transmits a display signal including image data to a display panel, and displays an image corresponding to the image data on the display panel.

The flat panel display device may be configured to transmit a display signal through PPDS (Point-to-Point Differential Signaling), RSDS (Reduced Swing Differential Signaling), or mini-LVDS (mini Low Voltage Differential Signaling).

The PPDS is vulnerable to EMI (Electromagnetic Interference), and may cause a data sample error when a skew exists between a clock signal and image data which are transmitted through different transmission lines. The mini-LVDS and RSDS are configured to separately transmit image data and a master clock signal for recovering the image data. The mini-LVDS and RSDS may cause a signal distortion due to a reflected wave which is generated by impedance mis-match of a transmission line for transmitting the master clock signal, and are vulnerable to EMI.

In order to solve the above-described problems, a protocol having a clock signal embedded in image data has been proposed. In this case, the image data and the clock signal are transmitted through the same transmission line, and the protocol is referred to as CEDS (Clock Embedded Data Signaling).

However, the conventional CEDS protocol needs to secure a sufficient margin before and after the point of time that a clock signal is extracted between image data, in order to deal with a high-frequency operation.

In the conventional CEDS protocol, the edge of a time point at which a clock signal is extracted is pinned to a rising or falling edge. Thus, a dummy signal which is positioned after the last bit of the image data must transition to the pinned edge state for extracting a clock signal.

When the dummy signal is pinned to a high level and the last bit of the image data is at a low level or when the dummy signal is pinned to a low level and the last bit of the image data is at a high level, a level difference exists between the last bit of the image data and the dummy signal. Thus, a level transition may occur between the last bit of the image data and the dummy signal. The level transition which occurs before the dummy signal may occur for each of the image data.

That is, in the conventional CEDS protocol, a level transition may occur between the last bit of the image data and the dummy signal. As a result, the dummy signal which is pinned to extract the clock signal may periodically cause EMI on a basis of image data.

SUMMARY

Various embodiments are directed to an apparatus and method for transmitting a display signal, which is capable of securing a sufficient margin before and after the point of time that a clock signal is extracted between image data, thereby smoothly dealing with a high-frequency operation.

Also, various embodiments are directed to an apparatus and method for transmitting a display signal, in which one or more of a dummy signal and a clock signal are configured to have a plurality of bits, in order to secure a sufficient margin before and after the point of time that the clock signal is extracted between image data.

Also, various embodiments are directed to an apparatus and method for transmitting a display signal, in which the state of a subsequent dummy signal can be determined to have a rising edge or falling edge based on the state of the last bit of each image data, such that a system interface can transmit a clock signal in a random state, thereby preventing periodic EMI.

In an embodiment, an apparatus for transmitting a display signal may include: a transmitter configured to transmit a display signal in which a dummy signal and a clock signal are sequentially embedded between image data; and a receiver configured to receive the display signal. The dummy signal may have a level dependent on the level of the last bit of the image data, and the clock signal may have a level to which the dummy signal transitioned.

In an embodiment, a method for transmitting a display signal may include: providing a dummy signal having a level dependent on the level of the last bit of image data; generating a clock signal to have a level to which the dummy signal transitioned, such that the clock signal forms a periodic edge; and outputting a display signal, in which the dummy signal and the clock signal are sequentially embedded between the image data, to a receiver.

DETAILED DESCRIPTION

Figure 1:
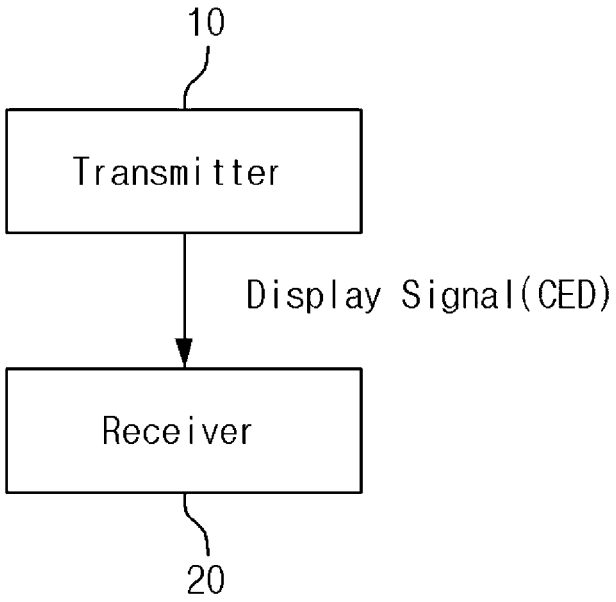
FIG. 1 is a block diagram illustrating an apparatus for transmitting a display signal according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

Referring to FIG. 1, an apparatus for transmitting a display signal according to an embodiment of the present invention transmits a display signal CED between a transmitter and a receiver 20. The display signal CED has a CEDS protocol in which a dummy signal DM and a clock signal CLK are embedded between image data D<0:n>. The transmitter 10 transmits the image data D<0:n>, the dummy signal DM, and the clock signal CLK to the receiver 20 through the same signal line.

Each of the image data D<0:n> of the display signal CED may include a plurality of bits, and the dummy signal DM and the clock signal CLK may have the same level of amplitude as the image data D<0:n>. The image data D<0:n> of the display signal CED may be configured as a single-ended signal or a pair of differential signals, and the last bit D<n> of the image data D<0:n>, the dummy signal DM, and the clock signal CLK may be configured as single-ended signals.

The display signal CED may have different formats in a clock training period and an embedded period. The display signal CED may include only the clock signal CLK at the clock training period, and have a protocol in which the dummy signal DM and the clock signal CLK are embedded between the respective image data D<0:n>, at the embedded period.

The clock training period may be understood as a period in which lock is turned off (LOCK OFF) because the clock signal CLK is not stable, and the display signal CED including only the clock signal CLK is transmitted in order to perform a synchronization operation for stabilizing the clock signal CLK. The embedded period may be understood as a period in which lock is turned on (LOCK ON) because the clock signal CLK is stable, and the display signal CED including the image data D<0:n>, the dummy signal DM, and the clock signal CLK is transmitted in a normal format for display. When lock is turned off, a lock signal LOCK may be disabled to a logic low level L ("0"), and when lock is turned on, the lock signal LOCK may be enabled to a logic high level H ("1"). The lock signal LOCK will be described with reference to the operation of the apparatus according to the present embodiment.

The transmitter 10 is configured to transmit a display signal in which the dummy signal DM and the clock signal CLK are embedded, between the respective image data D<0:n>. The receiver 20 is configured to receive the display signal CED, recover the clock signal CLK and the image data D<0:n> from the display signal CED, and generate a source driving signal (not illustrated) using the recovered clock signal CLK and image data D<0:n>. The source driving signal may be provided to a display panel (not illustrated) to display an image.

In the present embodiment, the display signal CED outputted from the transmitter 10 may include the dummy signal DM and the clock signal CLK which are sequentially embedded between the respective image data D<0:n>, the dummy signal DM may have a level dependent on the level of the last bit D<n> of the image data D<0:n>, and the clock signal CLK may have a level to which the dummy signal DM transitioned.

When the dummy signal DM is dependent on the level of the last bit D<n> of the image data D<0:n>, it may indicate that the dummy signal DM is set to a logic low level "0" or logic high level "1" in case where the value of the last bit D<n> of the image data D<0:n> is at a logic low level "0" or logic high level "1". When the clock signal CLK has a level to which the dummy signal DM transitioned, it may indicate that the clock signal CLK has a logic high level "1" in case where the dummy signal DM is at a logic low level "0", and has a logic low level "0" in case where the dummy signal DM is at a logic high level "1". That is, a periodic edge may be formed between the dummy signal DM and the clock signal CLK. The edge may correspond to a rising edge which transitions from a logic low level "0" to a logic high level "1" or a falling edge which transitions from a logic high level "1" to a logic low level "0".

Each of the dummy signal DM and the clock signal CLK within the display signal CED may include one bit.

Alternatively, one or more of the dummy signal DM and the clock signal CLK within the display signal CED may include two bits at the same level. That is, one or more of the dummy signal DM and the clock signal CLK may be set to two bits "00" at a logic low level or two bits "11" at a logic high level. The clock signal CLK may have a level to which the dummy signal DM transitioned. More specifically, the display signal CED may include a 1-bit dummy signal DM and a 2-bit clock signal CLK, a 2-bit dummy signal DM and a 1-bit clock signal CLK, or a 2-bit dummy signal DM and a 2-bit clock signal CLK.

The modified protocols of the display signal CED according to the present embodiment will be described below with reference to FIGS. 11 to 14. In the embodiments of FIGS. 1 to 10, suppose that the display signal CED including a 1-bit dummy signal DM and a 1-bit clock signal CLK is used.

Figure 2:
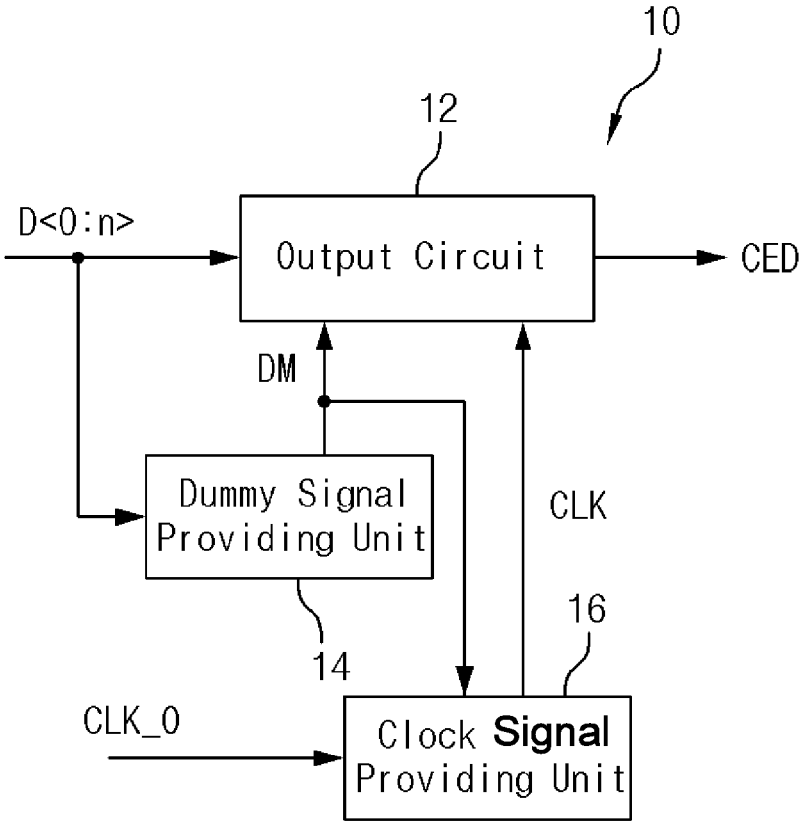
FIG. 2 is a block diagram illustrating an example of a transmitter of FIG. 1.

As illustrated in FIG. 2, the transmitter 10 may include an output circuit 12, a dummy signal providing unit 14, and a clock signal providing unit 16.

The dummy signal providing unit 14 provides a dummy signal DM having a level dependent on the level of the last bit D<n> of the image data D<0:n>. That is, the dummy signal providing unit 14 may receive the last bit D<n> of the image data D<0:n>, and output the dummy signal DM retaining the value of the last bit D<n>. The dummy signal providing unit 14 may include a latch or buffer, for example.

The clock signal providing unit 16 may be configured to receive a clock signal CLK_O and the dummy signal DM provided from the dummy signal providing unit 14, generate a clock signal CLK to have a level from which the level of the dummy signal DM transitioned, and provide the clock signal CLK to the output circuit 12.

The clock signal CLK_O inputted to the clock signal providing unit 16 may be provided from outside the transmitter or generated in the transmitter 10. The clock signal providing unit 16 may include a level shifter, inverter, or logic circuit.

The output circuit 12 may be configured to generate a serial signal in which the image data D<0:n>, the dummy signal DM, and the clock signal CLK are sequentially arranged, and transmit the serial signal as the display signal CED. The output circuit 12 may include a parallel-serial converter.

Figure 3:
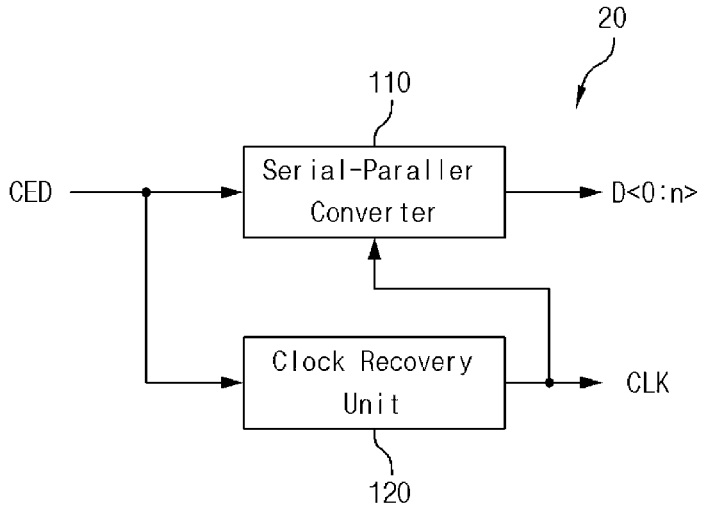
FIG. 3 is a block diagram illustrating an example of a receiver of FIG. 1.

As illustrated in FIG. 3, the receiver 20 includes a serial-parallel converter 110 and a clock recovery unit 120.

The clock recovery unit 120 may serve to recover the clock signal CLK included in the display signal CED. The clock signal CLK recovered by the clock recovery unit 120 is used to recover the image data D<0:n> included in the display signal CED.

The clock recovery unit 120 detects a periodic edge signal EDGE corresponding to an edge included in the display signal CED, and recovers the clock signal CLK using the edge signal EDGE.

The serial-parallel converter 110 is configured to convert the image data D<0:n> included in series in the display signal CED into parallel image data, using the clock signal CLK recovered by the clock recovery unit 120, and output the parallel image data to recover the actual image data D<0:n>.

Figure 4:
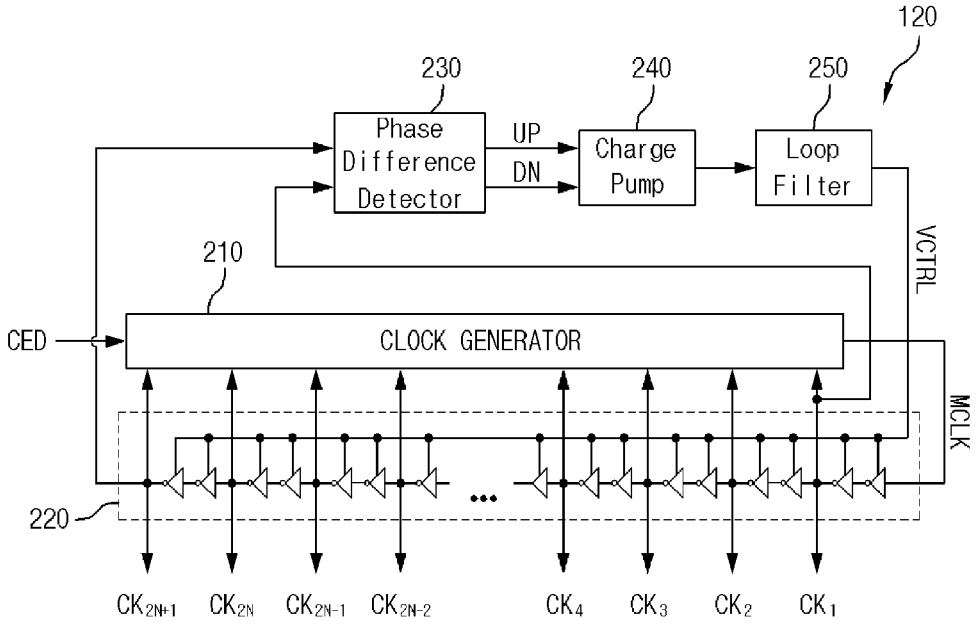
FIG. 4 is a block diagram illustrating an example of a clock recovery unit of FIG. 3.

FIG. 4 is a diagram illustrating the clock recovery unit 120 of FIG. 3.

Referring to FIG. 4, the clock recovery unit 120 may include a clock generator 210, a voltage controlled delay line 220, a phase difference detector 230, a charge pump 240, and a loop filter 250.

The clock generator 210 recovers a master clock signal MCLK from the display signal CED. For this operation, the clock generator 210 generates a mask signal MASK, a pull-up control signal PU, and a pull-down control signal PD, which are to be used therein, using a plurality of delayed clock signals $CK_1, CK_2, \ldots, CK_{2N+1}$ obtained by delaying the master clock signal MCLK by different times through the voltage controlled delay line 220. The mask signal MASK, the pull-up control signal PU, and the pull-down control signal PD will be described below with reference to FIG. 5.

The voltage controlled delay line 220 generates the plurality of delayed clock signals $CK_1, CK_2, \ldots, CK_{2N+1}$ using a plurality of inverters connected in series. Since each of the delayed clock signals $CK_1, CK_2, \ldots, CK_{2N+1}$ is an output signal from each two inverters connected in series, the delayed clock signal has the same phase as the master clock signal MCLK, but is delayed by the response delay time of two inverters.

The phase difference detector 230 selectively activates an up signal UP and a down signal DN in response to a phase difference between the display signal CED and one delayed clock signal $CK_1$ among the plurality of delayed clock signals $CK_1, CK_2, \ldots, CK_{2N+1}$. The delayed clock signal $CK_1$ is only an example.

The charge pump 240 generates an output voltage corresponding to the up signal UP and the down signal DN, and the loop filter 250 generates a control voltage VCTRL according to the output voltage of the charge pump 240.

The control voltage VCTRL serves as a driving voltage for the plurality of inverters forming the voltage controlled delay line 220. When the control voltage VCTRL is high, the response delay time of each inverter is decreased because the current supplied to the inverter increases. On the other hand, when the control voltage VCTRL is low, the response delay time of each inverter is increased because the current supplied to the inverter decreases. Thus, the phase difference between the delayed clock signal $CK_1$ and the display signal CED may be controlled.

In the above-described configuration, the clock recovery unit 120 may select any one of the plurality of delayed clock signals $CK_1, CK_2, \ldots, CK_{2N+1}$ obtained by delaying the master clock signal MCLK by different times, as the recovered clock signal CLK.

Figure 5:
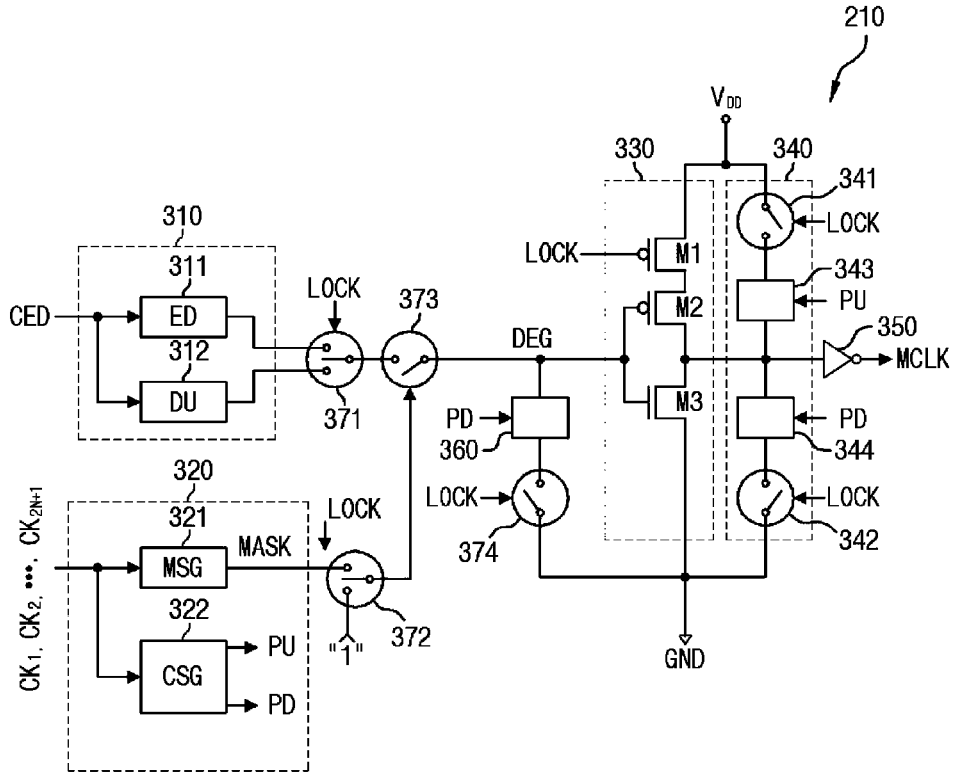
FIG. 5 is a circuit diagram illustrating an example of a clock generator of FIG. 4.

FIG. 5 is a diagram illustrating the clock generator 210 of FIG. 4.

The clock generator 210 recovers the master clock signal MCLK from the display signal CED, and includes a display signal processing unit 310, a control signal generation unit 320, switches 371 to 374, a first inverter 330, a second inverter 350, a pull-up and pull-down unit 340, and a pull-down block 360.

The display signal processing unit 310 includes an edge detector (ED) 311 and a delay unit (DU) 312. The edge detector 311 detects rising and falling edges included in the display signal CED and generates an edge signal EDGE, and the delay unit 312 delays the display signal CED by a predetermined time.

The control signal generation unit 320 includes a mask signal generator (MSG) 321 and an up-down control signal generator (CSG) 322. The mask signal generator 321 generates the mask signal MASK using two delayed clock signals which have a time interval including the time at which the edge signal EDGE is activated, among the plurality of delayed clock signals $CK_1, CK_2, \ldots, CK_{2N+1}$.

The up-down control signal generator 322 generates a pull-down control signal PD using two delayed clock signals which have a predetermined time interval for performing a pull-down operation during a predetermined time from the point of time that the edge signal EDGE is detected by the mask signal MASK, among the plurality of delayed clock signals $CK_1, CK_2, \ldots, CK_{2N+1}$. Furthermore, the up-down control signal generator 322 generates a pull-up control signal PU using two delayed clock signals which have a predetermined time interval for performing a pull-up operation during a predetermined time after the mask signal MASK is activated to perform a pull-up operation, among the plurality of delayed clock signals $CK_1, CK_2, CK_{2N+1}$. The up-down control signal generator 322 may generate the pull-down control signal PD and the pull-up control signal PU such that the pull-down end point and the pull-up start point coincide with each other. Furthermore, the up-down control signal generator 322 may generate the pull-down control signal PD and the pull-up control signal PU such that the end point of the mask signal MASK and the start point of the pull-down operation coincide with each other.

The switch 371 is switched to select one of the edge signal EDGE of the edge detector 311 and the output signal of the delay unit 312 in response to the lock signal LOCK.

The switch 372 is switched to select one of the mask signal MASK and a logic high signal "1" in response to the lock signal LOCK.

The switch 373 is operated to transmit the delayed display signal CED received through the switch 371 when the logic high signal "1" is outputted from the switch 372. When the mask signal MASK is outputted from the switch 372, the switch 373 is operated to transmit the edge signal EDGE of the edge detector 311, which is received through the switch 371, in response to the period in which the mask signal MASK is activated. In FIG. 5, DEG represents an output signal of the switch 373.

The first inverter 330 inverts the phase of the output signal DEG of the switch 373 in response to the lock signal LOCK in a lock-on state. The first inverter 330 includes a PMOS transistor M1 configured to receive the lock signal LOCK through the gate thereof and a PMOS transistor M2 and an NMOS transistor M3 which are configured to receive the output signal DEG through the gates thereof. The PMOS transistor M2 and the NMOS transistor M3 are coupled in a CMOS structure, and the PMOS transistor M1 transmits a supply voltage $V_{DD}$ to the PMOS transistor M2 according to the lock signal LOCK.

The second inverter 350 is configured to invert the phase of the output signal of the first inverter 330 and output the inverted signal as the master clock signal MCLK.

The pull-up and pull-down unit 340 pull-up or pull-down drives the voltage of the input terminal of the second inverter 350 in response to the lock signal LOCK, the pull-down control signal PD, and the pull-up control signal PU.

The pull-up and pull-down unit 340 includes a switch 341, a switch 342, a pull-up block 343, and a pull-down block 344. The switch 341 is switched to transmit the supply voltage $V_{DD}$ to the pull-up block 343 in response to the lock signal LOCK. The switch 342 is switched to transmit a ground voltage GND to the pull-down block 344 in response to the lock signal LOCK. The pull-up block 343 performs a pull-up operation of raising the voltage of the input terminal of the second inverter 350 in response to the pull-up control signal PU, when the switch 341 is turned on. The pull-down block 344 performs a pull-down operation of lowering the voltage of the input terminal of the second inverter 350 in response to the pull-down control signal PD, when the switch 342 is turned on.

The pull-down block 360 is installed between the input terminal of the first inverter 330 and the switch 374, and pull-down drives the voltage level of the input terminal of the first inverter 330 in response to the pull-down control signal PD, when the switch 374 is turned on in response to the lock signal LOCK.

When the lock signal LOCK is in a logic low state, the switch 371 transmits the delayed display signal outputted from the delay unit 312 to the switch 373, the switch 372 selects the logic high signal "1" and transmits the selected signal to the switch 373, and the switches 374, 341, and 342 are turned off. At this time, the switch 373 maintains the turn-on state in response to the logic high signal "1" provided from the switch 372.

When the lock signal LOCK is in a logic high state, the switch 371 transmits the edge signal EDGE outputted from the edge detector 311 as the detected edge signal DEG to the switch 373, the switch 372 selects the mask signal MASK outputted from the mask signal generator 321 and transmits the selected signal to the switch 373, and the switches 374, 341, and 342 are turned on. At this time, the switch 373 is turned on during the period in which the mask signal MASK provided from the switch 372 is activated. As a result, the detected edge signal DEG is transmitted to the first inverter 330 through the switch 373 during the period in which the mask signal MASK is activated.

The clock generator 210 having the above-described configuration performs a clock training operation, which will be described with reference to FIG. 6, at the clock training period in which the lock signal LOCK corresponds to a logic low state, and performs a clock recovery operation, which will be described with reference to FIGS. 7 to 10, during the embedded period in which the lock signal LOCK corresponds to a logic high state.

First, the clock training operation of the clock generator 210, which corresponds to the clock training period when the lock signal LOCK is logic low, will be described with reference to FIG. 6. In FIG. 6, a solid line indicates a transmission path of a signal.

Figure 6:
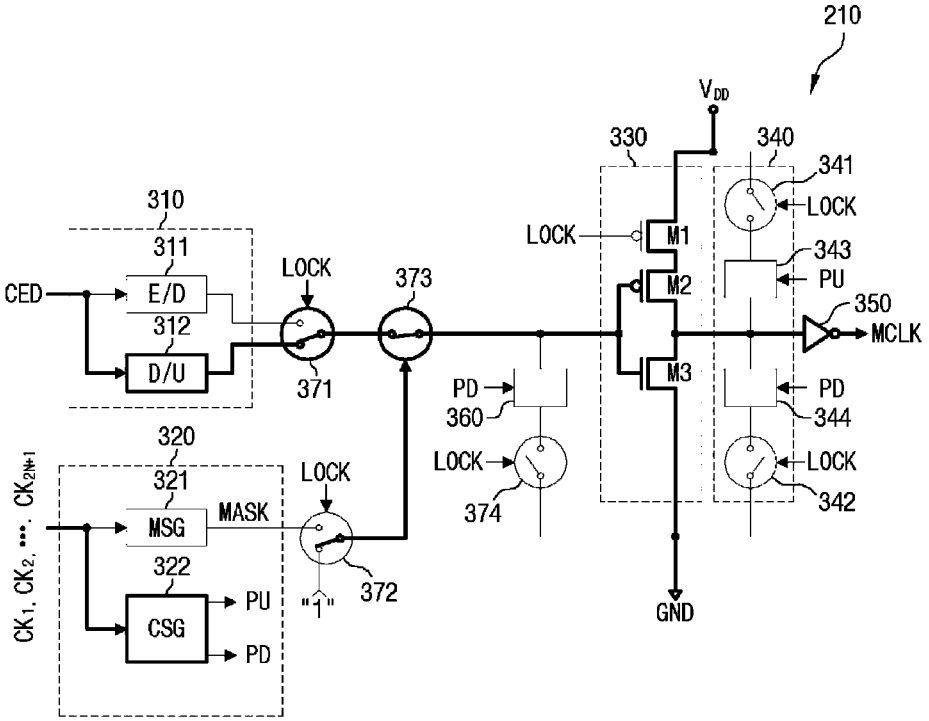
FIG. 6 is a circuit diagram for describing the operation of the clock generator, which corresponds to a clock training period.

In FIG. 6, the delayed display signal CED outputted from the delay unit 312 is transmitted to the first inverter 330 according to the switching states of the switches 371 to 373, which correspond to the lock signal LOCK in a logic low state. In response to the lock signal LOCK in a logic low state, the switches 374, 341, and 342 are turned off, and the PMOS transistor M1 is normally operated. Thus, the first inverter 330 bypasses the delayed display signal CED to the second inverter 350. Then, the second inverter 350 transmits the delayed display signal CED as the master clock signal MCLK.

At the clock training period, the display signal CED includes only the clock signal CLK. Thus, at the clock training period, the clock signal CLK of the display signal CED may be provided as the master clock signal MCLK. That is, the master clock signal MCLK and the display signal CED have the same phase. Furthermore, the recovered clock signal CLK and the display signal CED also have the same phase.

Figure 7:
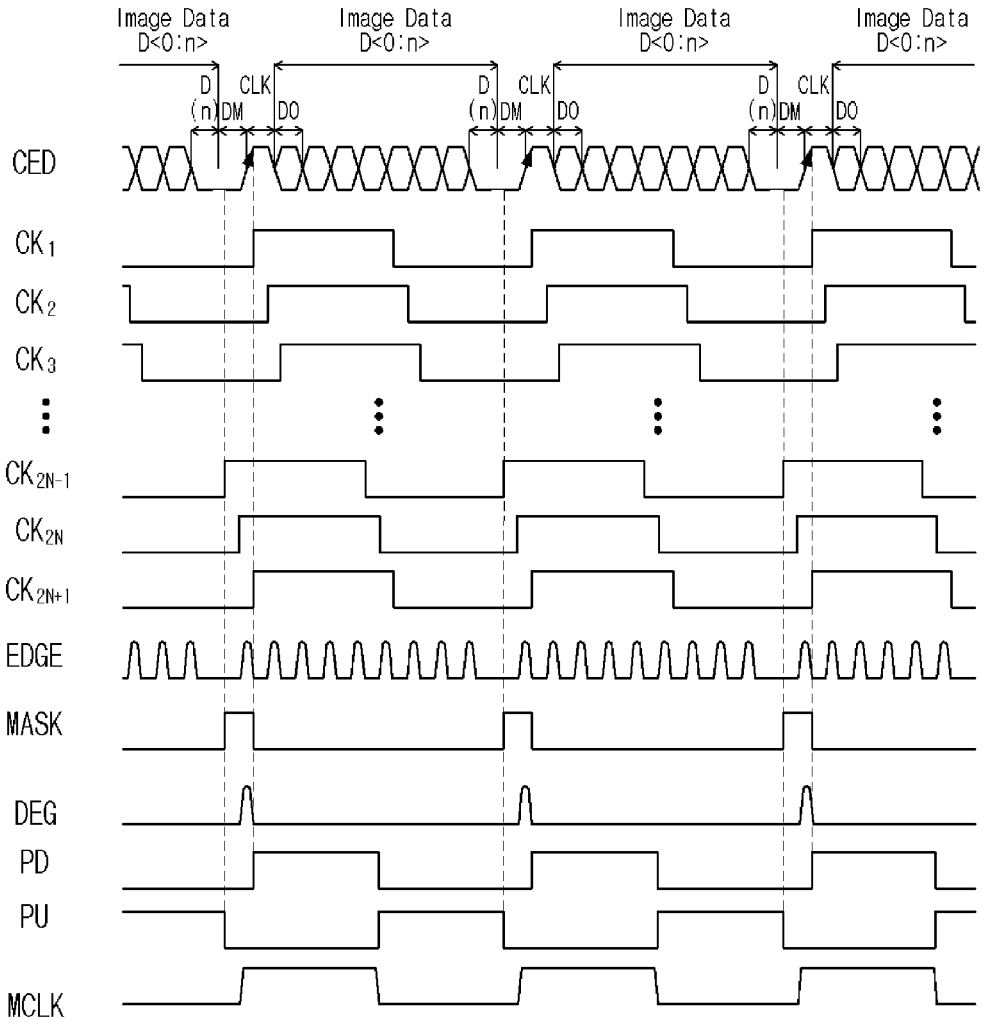
FIG. 7 is a waveform diagram for describing the operation of the clock generator, which corresponds to an embedded period.
Figure 8:
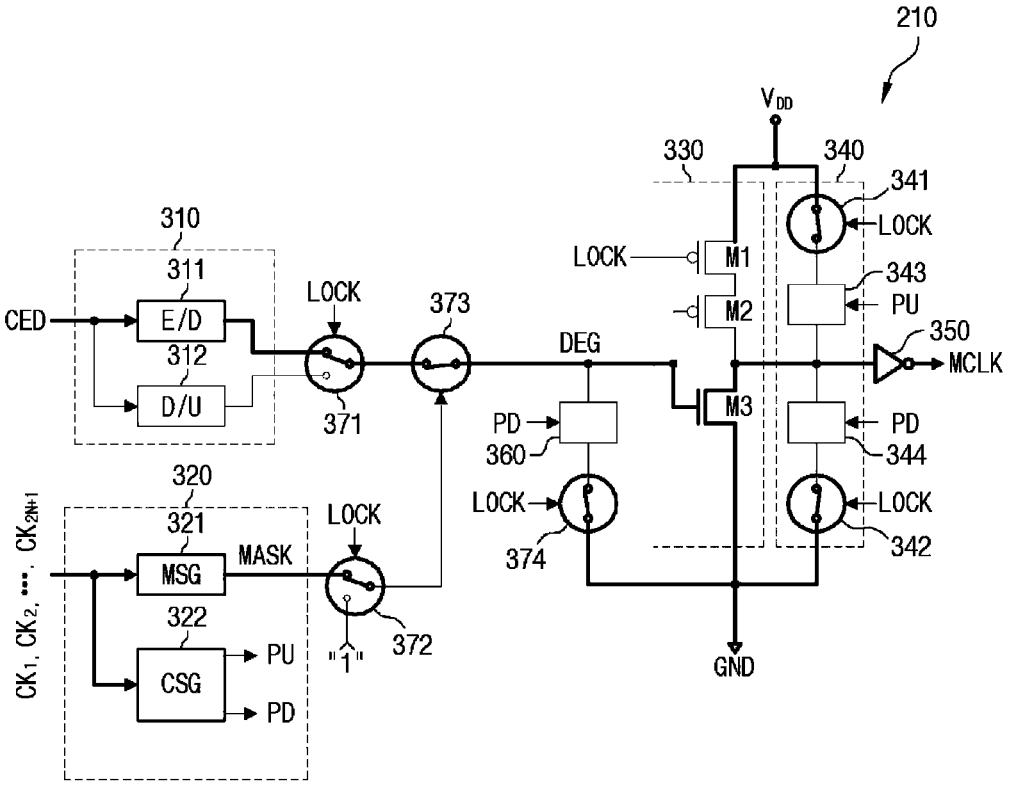
FIG. 8 is a circuit diagram for describing an operation of determining a rising edge of a clock signal.
Figure 9:
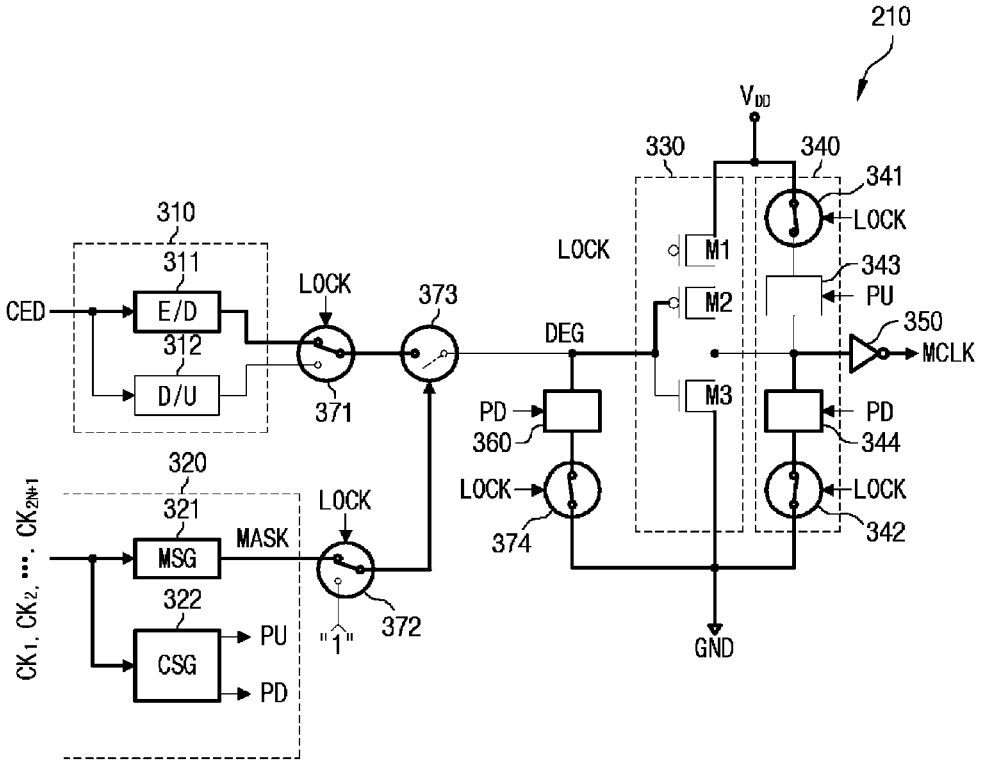
FIG. 9 is a circuit diagram for describing a pull-down operation for maintaining an active state of the clock signal.
Figure 10:
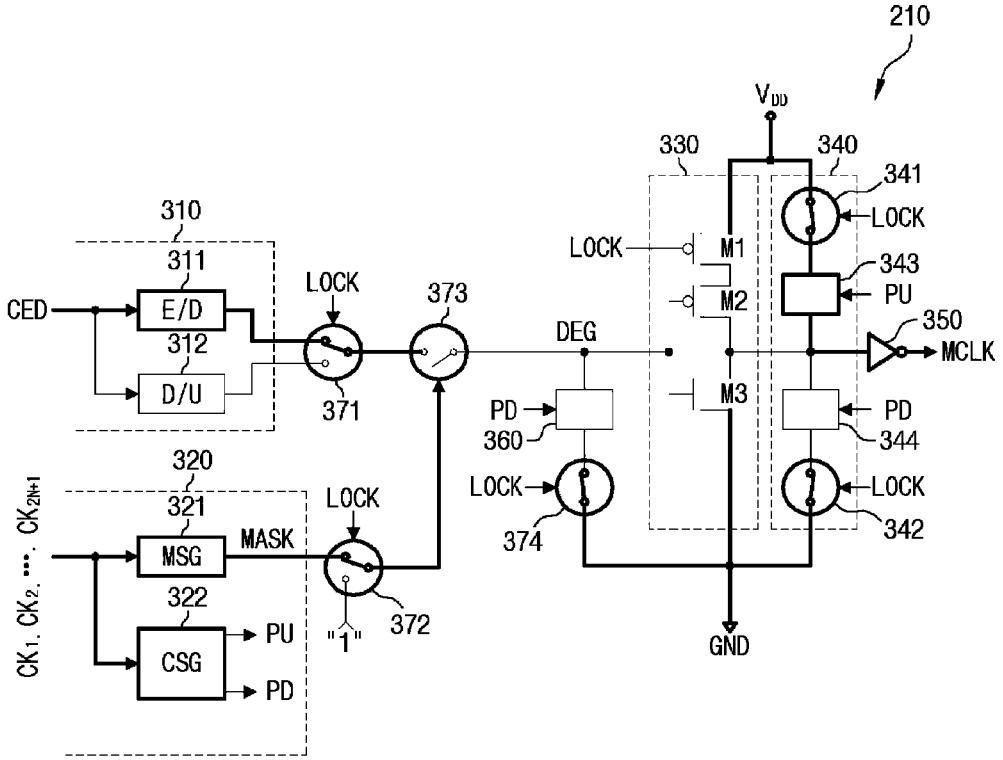
FIG. 10 is a circuit diagram for describing a pull-up operation for determining a falling edge of the clock signal.

Referring to FIGS. 7 to 10, the clock signal recovery operation of the clock generator 210, which corresponds to the embedded period when the lock signal LOCK is logic high, will be described. In response to the embedded period, the display signal CED includes the image data D<0:n>, the dummy signal DM, and the clock signal CLK. In FIGS. 8 to 10, a solid line indicates a transmission path of a signal.

Referring to FIG. 7, the edge detector 311 detects a periodic edge signal EDGE corresponding to an edge included in the display signal CED, and the mask signal generator 321 generates the mask signal MASK which is activated during a period including one or more edges from the point of time that the dummy signal DM is started. Then, the clock generator 210 determines a rising edge of the master clock signal MCLK in synchronization with the edge signal DEG which is included and detected in the period in which the mask signal MASK is activated, retains the master clock signal MCLK through a pull-down operation after the mask signal MASK is activated, and determines a falling edge of the master clock signal MCLK through a pull-up operation at a predetermined time after the mask signal MASK is activated.

When the master clock signal MCLK is recovered by the clock generator 210, the clock recovery unit 120 generates the delayed clock signals $CK_1$, $CK_2$, . . . , $CK_{2N+1}$ by sequentially delaying the master clock signal MCLK by a predetermined unit time, and selects any one of the clock signals $CK_1$, $CK_2$, . . . , $CK_{2N+1}$ as the recovered clock signal CLK.

The mask signal MASK and the pull-down and pull-up operations may be enabled according to one or more delayed clock signals which are equal to or different from each other among the delayed clock signals $CK_1$, $CK_2$, . . . , $CK_{2N+1}$.

The configuration in which the clock generator 210 determines the rising edge of the master clock signal MCLK in synchronization with the edge signal DEG which is included and detected in the period in which the mask signal MASK is activated will be described with reference to FIG. 8.

Referring to FIG. 8, since the lock signal LOCK is logic high and the activated mask signal MASK is transmitted to the switch 373, the switches 371 and 373 are turned on. Thus, the edge signal EDGE included in the period in which the mask signal MASK is activated is transmitted as the detected edge signal DEG to the first inverter 330. At this time, since the pull-up control signal PU and the pull-down control signal PD are not yet activated, a pull-down or pull-up operation for inputs of the first and second inverters 330 and 350 is not applied.

Thus, the NMOS transistor M3 of the first inverter 330 is driven by the detected edge signal DEG, and the first inverter 330 provides a low-level voltage to the second inverter 350 in response to the detected edge signal DEG. As a result, the second inverter 350 recovers an edge of the master clock signal MCLK, which is synchronized with the detected edge signal DEG.

The configuration in which the clock generator 210 retains the master clock signal MCLK through a pull-down operation after the mask signal MASK is activated will be described with reference to FIG. 9.

Referring to FIG. 9, since the deactivated mask signal MASK is transmitted to the switch 373, the switch 373 is turned off. Then, a pull-down operation is started by the activated pull-down control signal PD. At this time, the pull-up control signal PU maintains an inactive state.

When the pull-down operation is started, the ground voltage GND for the pull-down operation is transmitted to the input terminal of the second inverter 350 through the switch 342 which is turned on in response to the lock signal LOCK in a logic high state, and the input voltage of the second inverter 350 is pinned to the ground voltage GND. As a result, the second inverter 350 outputs a high-level voltage such that the master clock signal MCLK maintains an active state according to the input which is retained at a low level.

At this time, the reason why the input voltage of the first inverter 330 is pinned to the ground voltage GND by the pull-down block 360 is in order to prevent a malfunction of the first inverter 330 due to an input voltage in a floating state.

The configuration in which the clock generator 210 determines a falling edge of the mask signal MASK through a pull-up operation at a predetermined time after the mask signal MASK is activated will be described with reference to FIG. 10.

Referring to FIG. 10, since the deactivated mask signal MASK is transmitted to the switch 373, the switch 373 is turned off. Then, a pull-up operation is started by the activated pull-up control signal PU. At this time, the pull-down control signal PD is switched to an inactive state.

When the pull-up operation is started, the supply voltage $V_{DD}$ for the pull-up operation is transmitted to the input terminal of the second inverter 350 through the switch 341 which is turned on by the lock signal LOCK in a logic high state, and the input voltage of the second inverter 350 is pinned to the supply voltage $V_{DD}$. As a result, the second inverter 350 deactivates the master clock signal MCLK according to the input which is retained at a high level. That is, a falling edge of the master clock signal MCLK is determined by the start of the pull-up operation.

As described with reference to FIGS. 8 to 10, the recovered master clock signal MCLK may be converted into the plurality of delayed clock signals $CK_1, CK_2, \ldots, CK_{2N+1}$, obtained by delaying the master clock signal MCLK by different times, and any one of the delayed clock signals $CK_1, CK_2, \ldots, CK_{2N+1}$ may be selected as the recovered clock signal CLK.

As described with reference to FIGS. 7 to 10, the apparatus for transmitting a display signal according to the present embodiment may recover the clock signal CLK in response to the edge of the display signal CED which is transmitted in response to the embedded period, while including the image data D<0:n>, the dummy signal DM, and the clock signal CLK.

The present embodiment is based on the supposition that a display signal CED including a 1-bit dummy signal DM and a 1-bit clock signal CLK is used.

Furthermore, in the display signal CED outputted from the transmitter 10, the dummy signal DM may have a level dependent on the level of the last bit D<n> of the image data D<0:n>, and the clock signal CLK may have a level to which the dummy signal DM transitioned.

The apparatus according to the present embodiment detects an edge of the display signal CED, and recovers the master clock signal MCLK based on the detected edge. The master clock signal MCLK is used to recover a rising edge based on the edge signal EDGE included in the period in which the master signal MASK is activated, and a falling edge is recovered at predetermined pull-up and pull-down times.

Although two or more edge signals EDGE are included in the period in which the mask signal MASK is activated, a rising edge of the master clock signal MCLK to be recovered may be determined in synchronization with the first edge signal EDGE. The edge signal EDGE has no influence on pull-down and pull-up operations for recovering the master clock signal MCLK.

As described above, the apparatus according to the present embodiment may recover the master clock signal MCLK using the edge signal EDGE, and select any one of the plurality of delayed clock signals $CK_1, CK_2, \ldots, CK_{2N+1}$, obtained by delaying the master clock signal MCLK, as the recovered clock signal CLK. Furthermore, the mask signal MASK and the pull-up and pull-down operations may be determined by the delayed clock signal selected among the plurality of delayed clock signals $CK_1, CK_2, \ldots, CK_{2N+1}$.

Thus, according to the present embodiment, a flexible protocol can be implemented in comparison to the conventional system which recovers a clock signal in synchronization with the display signal CED.

That is, as described below with reference to FIGS. 11 to 14, the apparatus according to the present embodiment may recover the clock signal CLK using the display signal CED having the protocol in which both of the dummy signal DM and the clock signal CLK are configured to have one bit or one or more of the dummy signal DM and the clock signal CLK are configured to have two bits. Thus, a variety of protocols considering a margin for recovering the clock signal CLK in response to a high-frequency operation can be applied.

Figure 11A:
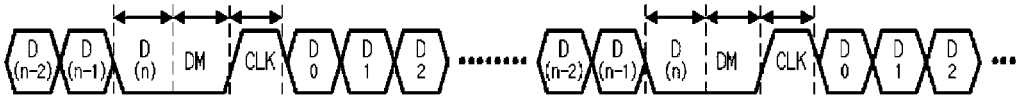
FIGS. 11A, 11B, 12A, 12B, 13A, 13B, 14A and 14B are waveform diagrams illustrating protocols of a display signal.

FIG. 11A illustrates the case in which the last bit D<n> of the image data D<0:n> has a logic low level, the dummy signal DM is dependent on the level of the last bit D<n> of the image data D<0:n> and has the same logic low level, and the clock signal CLK has a logic high level to which the dummy signal DM transitioned. At this time, a periodic rising edge may be formed between the dummy signal DM and the clock signal CLK.

Figure 11B:
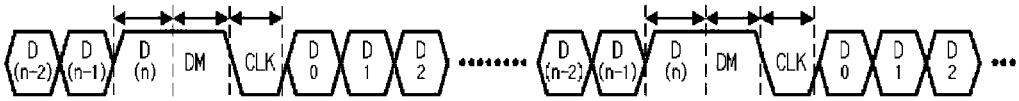

FIG. 11B illustrates the case in which the last bit D<n> of the image data D<0:n> has a logic high level, the dummy signal DM is dependent on the level of the last bit D<n> of the image data D<0:n> and has the same logic high level, and the clock signal CLK has a logic low level to which the dummy signal DM transitioned. At this time, a periodic falling edge may be formed between the dummy signal DM and the clock signal CLK.

In FIGS. 11A and 11B, the point of time that the mask signal MASK is activated may be defined as the point of time that the dummy signal DM is started.

In FIGS. 11A and 11B, since the last bit D<n> of the image data D<0:n> in the display signal CED has the same level as the dummy signal DM, a two-bit margin is secured from a pulse of the edge signal EDGE by the transition of the last bit D<n> of the image data D<0:n> to a pulse of the edge signal EDGE by the transition of the clock signal CLK. This indicates that a margin for the point of time that the mask signal is activated is secured as two bits. Thus, the clock signal CLK can be smoothly recovered even during a high-frequency operation.

Furthermore, in FIGS. 11A and 11B, the state of the subsequent dummy signal DM may be determined to have a rising edge or falling edge, based on the state of the last bit of the image data.

When the last bit D<n> of the image data D<0:n> is at a logic low level, the dummy signal DM may be determined to a logic low level, and when the last bit D<n> of the image data D<0:n> is at a logic high level, the dummy signal DM may be determined to a logic high level. Thus, when the dummy signal DM is determined as illustrated in FIGS. 11A and 11B, a level transition does not occur between the dummy signal DM and the last bit D<n> of the image data D<0:n>.

The apparatus according to the present embodiment can prevent a level transition which may periodically occur at each of the image data D<0:n> in the conventional CEDS method. Furthermore, the dummy signal DM may be dependent on the value of the image data D<0:n> and thus randomly occur, and the clock signal CLK may also be dependent on the dummy signal DM and thus randomly occur.

Therefore, the system interface can transmit the clock signal CLK in a random state to the receiver, thereby preventing the occurrence of periodic EMI at each of the image data and the clock signal which periodically transitions.

Furthermore, the display signal CED outputted from the transmitter 10 may have a level dependent on the level of the last bit D<n> of the image data D<0:n>, and one or more of the dummy signal DM and the clock signal CLK may have two bits at the same level. That is, one or more of the dummy signal DM and the clock signal CLK may be set to a 2-bit logic low signal of "00" or 2-bit logic high signal of "11". The clock signal CLK may have a level to which the dummy signal DM transitioned.

Figure 12A:
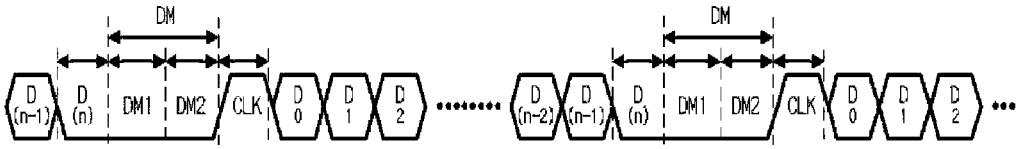
Figure 12B:
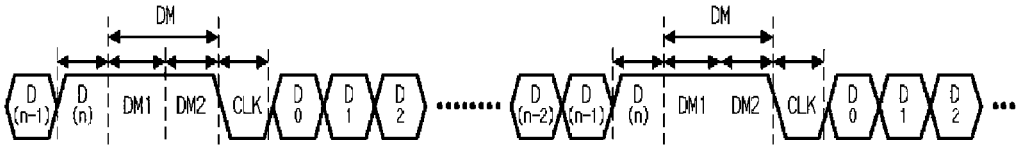

FIGS. 12A and 12B illustrate examples in which the dummy signal DM has two bits. FIG. 12A illustrates the case in which the last bit D<n> of the image data D<0:n> has a logic low level, the 2-bit dummy signal DM has the same logic low level "00" as the level of the last bit D<n> of the image data D<0:n>, and the 1-bit clock signal CLK has a logic high level to which the dummy signal DM transitioned. FIG. 12B illustrates the case in which the last bit D<n> of the image data D<0:n> has a logic high level, the 2-bit dummy signal DM has the same logic high level "11" as the level of the last bit D<n> of the image data D<0:n>, and the 1-bit clock signal CLK has a logic low level to which the dummy signal DM transitioned.

Unlike FIGS. 12A and 12B, the display signal CED according to the embodiment of the present invention including a 1-bit dummy signal DM and a 2-bit clock signal CLK.

Figure 13A:
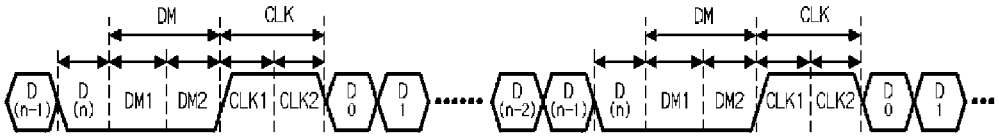
Figure 13B:
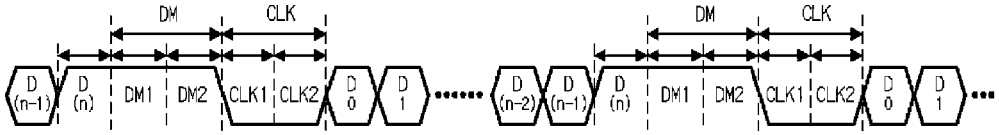

FIGS. 13A and 13B illustrate examples in which the dummy signal DM and the clock signal CLK have two bits. FIG. 13A illustrates the case in which the last bit D<n> of the image data D<0:n> has a logic low level, the 2-bit dummy signal DM has the same logic low level "00" as the level of the last bit D<n> of the image data D<0:n>, and the 2-bit clock signal CLK has a logic high level of "11" to which the dummy signal DM transitioned. FIG. 13B illustrates the case in which the last bit D<n> of the image data D<0:n> has a logic high level, the 2-bit dummy signal DM has the same logic high level "00" as the level of the last bit D<n> of the image data D<0:n>, and the 2-bit clock signal CLK has a logic low level of "00" to which the dummy signal DM transitioned.

Even when the display signals CED having the protocols illustrated in FIGS. 12 and 13 are used, a sufficient margin for extracting the clock signal CLK can be secured between the image data, because one or more of the dummy signal DM or the clock signal CLK have a plurality of bits.

In FIGS. 12 and 13, the state of the subsequent dummy signal DM may be determined to have a rising edge or falling edge, based on the state of the last bit of the image data, as illustrated in FIGS. 11A and 11B. Thus, the system interface can transmit the clock signal CLK in a random state to the receiver 20, thereby preventing the occurrence of periodic EMI.

Figure 14A:
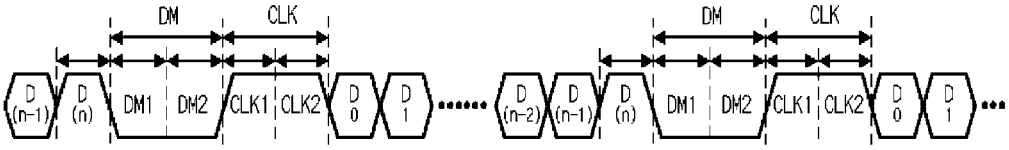
Figure 14B:
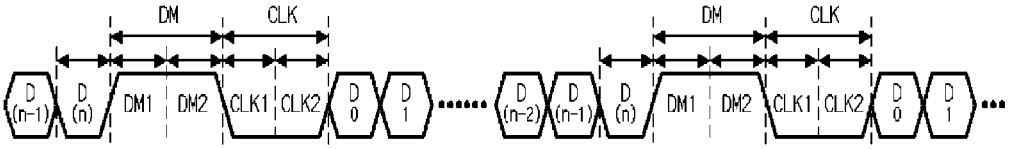

Furthermore, as illustrated in FIGS. 14A and 14B, the display signal CED according to the embodiment of the present invention may include the 2-bit dummy signal DM having the opposite level of the last bit D<n> of the image data D<0:n> and the 2-bit clock signal CLK having a level to which the dummy signal DM transitioned. The display signal CED of FIGS. 14A and 14B can secure a sufficient margin for extracting the clock signal CLK between the image data as illustrated in FIGS. 13A and 13B.

According to the embodiment of the present invention, the apparatus and method for transmitting a display signal can secure a sufficient margin before and after the point of time that a clock signal is extracted between image data, in response to when a high-frequency operation is performed to transmit a display signal, thereby guaranteeing a stable operation of the system.

Furthermore, since the dummy signal can maintain the state in which the level thereof is dependent on the last bit of the image data, the system interface can transmit a clock signal in a random state. As a result, it is possible to prevent the occurrence of periodic EMI.

While various embodiments have been described above, it will be understood to those skilled in the art that the embodiments described are by way of example only. Accordingly, the disclosure described herein should not be limited based on the described embodiments.

What is claimed is:

1. An apparatus for transmitting a display signal, comprising:

a transmitter configured to generate a dummy signal having a level dependent on the level of a last bit of image data, generate a clock signal having a level to which the dummy signal transitioned, and transmit a display signal in which the dummy signal and the clock signal are sequentially embedded between the image data; and a receiver configured to receive the display signal, detect a periodic edge signal corresponding to an edge included in the display signal, and recover the clock signal included in the display signal using the edge signal, wherein the transmitter comprises:

a dummy signal providing unit configured to receive the last bit of the image data and provide the dummy signal matching the same logic level as the last bit of the image data;

a clock signal providing unit configured to receive the dummy signal provided from the dummy signal providing unit, generate the clock signal having a level to which the dummy signal transitioned, and provide the clock signal; and an output circuit configured to receive the dummy signal of the dummy signal providing unit, the clock signal of the clock signal providing unit and the image data, generate a serial signal in which the image data, the dummy signal, and the clock signal are sequentially arranged, and transmit the serial signal as the display signal.

2. The apparatus of claim 1, wherein each of the dummy signal and the clock signal in the display signal is configured to have one bit.

3. The apparatus of claim 1, wherein one or more of the dummy signal and the clock signal in the display signal are configured to have two bits at the same level.

4. The apparatus of claim 1, wherein the last bit of the image data, the dummy signal, and the clock signal are configured as single-ended signals.

5. The apparatus of claim 1, wherein the receiver detects the periodic edge signal corresponding to the edge included in the display signal, generates a master clock signal using the edge signal, and selects any one of delayed clock signals obtained by sequentially delaying the master clock signal by a predetermined unit time, as the recovered clock signal.

6. The apparatus of claim 5, wherein the receiver activates a mask signal in response to the edge signal at which the dummy signal is started, determines a rising edge of the master clock signal in synchronization with the edge signal included in a period in which the mask signal is activated, retains the master clock signal through a pull-down operation after the mask signal is activated, and determines a falling edge of the master clock signal through a pull-up operation after the mask signal is activated.

7. The apparatus of claim 6, wherein the receiver controls activations of the mask signal, the pull-down operation, and the pull-up operation using one or more delayed clock signals which are equal to or different from each other, among the delayed clock signals.

8. An apparatus for transmitting a display signal, comprising:

a transmitter configured to generate a dummy signal having a level dependent on the level of a last bit of image data, generate a clock signal having a level to which the dummy signal transitioned, and transmit a display signal in which the dummy signal and the clock signal are sequentially embedded between the image data; and a receiver configured to receive the display signal, detect a periodic edge signal corresponding to an edge included in the display signal, and recover the clock signal included in the display signal using the edge signal, wherein the transmitter comprises:

a dummy signal providing unit configured to receive the last bit of the image data and provide the dummy signal rising or falling to a different logic level than the logic level of the last bit of the image data;

a clock signal providing unit configured to receive the dummy signal provided from the dummy signal providing unit, generate the clock signal having a level to which the dummy signal transitioned, and provide the clock signal; and an output circuit configured to receive the dummy signal of the dummy signal providing unit, the clock signal of the clock signal providing unit and the image data, generate a serial signal in which the image data, the dummy signal, and the clock signal are sequentially arranged, and transmit the serial signal as the display signal.

9. A method for transmitting a display signal, comprising:

receiving a last bit of image data;

providing a dummy signal matching a same logic level as the last bit of image data, wherein a level transition does not occur between the dummy signal and the last bit of image data;

generating a clock signal to have a level to which the dummy signal transitioned, such that the clock signal forms a periodic edge; and outputting a display signal, in which the dummy signal and the clock signal are sequentially embedded between the image data, to a receiver.

10. The method of claim 9, wherein each of the dummy signal and the clock signal in the display signal is configured to have one bit.

11. The method of claim 9, wherein the last bit of the image data, the dummy signal, and the clock signal are configured as single-ended signals.

12. The method of claim 9, further comprising a clock signal recovery process in which the receiver recovers the clock signal in response to the display signal, wherein the clock signal recovery process comprises:

detecting a periodic edge signal corresponding to an edge included in the display signal;

generating a mask signal which is activated during a period including one or more edge signals from the point of time that the dummy signal is started;

determining a rising edge of a master clock signal in synchronization with the edge signal included in the period in which the mask signal is activated;

retaining the master clock signal through a pull-down operation after the rising edge of the master clock signal is determined;

determining a fall edge of the master clock signal through a pull-up operation after the master clock signal is retained by the pull-down operation during a predetermined time; and generating delayed clock signals by sequentially delaying the master clock signal by a predetermined unit time, and selecting any one of the delayed clock signals as the recovered clock signal.

13. The method of claim 12, wherein one or more delayed clock signals which are equal to or different from each other, among the delayed clock signals, are used to control activations of the mask signal, the pull-down operation, and the pull-up operation.

* * * * *